US011391087B2

(12) United States Patent
Brunton

(10) Patent No.: US 11,391,087 B2
(45) Date of Patent: Jul. 19, 2022

(54) ROLLER DOOR BLADES AND ROLLER DOORS

(71) Applicant: AUTO MOSSA HOLDINGS LIMITED, Auckland (NZ)

(72) Inventor: Mark James Brunton, Auckland (NZ)

(73) Assignee: AUTO MOSSA HOLDINGS LIMITED, Auckland (NZ)

( * ) Notice: Subject to any disclaimer, the term of this patent is extended or adjusted under 35 U.S.C. 154(b) by 209 days.

(21) Appl. No.: 16/482,309

(22) PCT Filed: Jan. 31, 2018

(86) PCT No.: PCT/NZ2018/050007

§ 371 (c)(1),
(2) Date: Jul. 31, 2019

(87) PCT Pub. No.: WO2018/143827

PCT Pub. Date: Aug. 9, 2018

(65) Prior Publication Data

US 2020/0003004 A1 Jan. 2, 2020

(30) Foreign Application Priority Data

Jan. 31, 2017 (NZ) ..... 728732

(51) Int. Cl.
*E06B 9/58* (2006.01)
*E06B 9/13* (2006.01)

(52) U.S. Cl.
CPC ..... *E06B 9/13* (2013.01); *E06B 9/58* (2013.01); *E06B 2009/135* (2013.01)

(58) Field of Classification Search
CPC ..... E06B 9/13; E06B 9/56; E06B 9/58; E06B 9/581; E06B 2009/135; E06B 2009/1516
See application file for complete search history.

(56) References Cited

U.S. PATENT DOCUMENTS 2,839,135 A * 6/1958 Anderson ..... E06B 9/581 160/183
3,078,917 A * 2/1963 Recchione ..... E06B 9/58 D25/16

(Continued)

FOREIGN PATENT DOCUMENTS

EP 0 541 154 A1 5/1993

OTHER PUBLICATIONS

International Search Report and Written Opinion, dated May 18, 2018, from corresponding PCT application No. PCT/NZ2018/050007.

(Continued)

*Primary Examiner* — Johnnie A. Shablack
(74) *Attorney, Agent, or Firm* — Nixon & Vanderhye

(57) ABSTRACT

Roller doors made of flexible material have a number of uses, particularly for rapid access into cool stores. However, such doors require stiffening in the form of wind bars to prevent the doors blowing out in gusts of wind. The wind bars produce problems when rapidly closing a roller door, as the door blade of the roller door is rolled up onto a roller. And for doors in cool stores that are opened and closed hundreds of times a day, such problems are significant. The present roller door blade solves or minimizes the problems by fitting longitudinal spacer elements along the length of the door which act to provide space between adjacent layers of the door blade as it accumulates on the roller, allowing any wind bars of the door blade to be stowed on the roller without interfering or clashing with other wind bars.

20 Claims, 3 Drawing Sheets

(56) References Cited

U.S. PATENT DOCUMENTS

Figure 1:
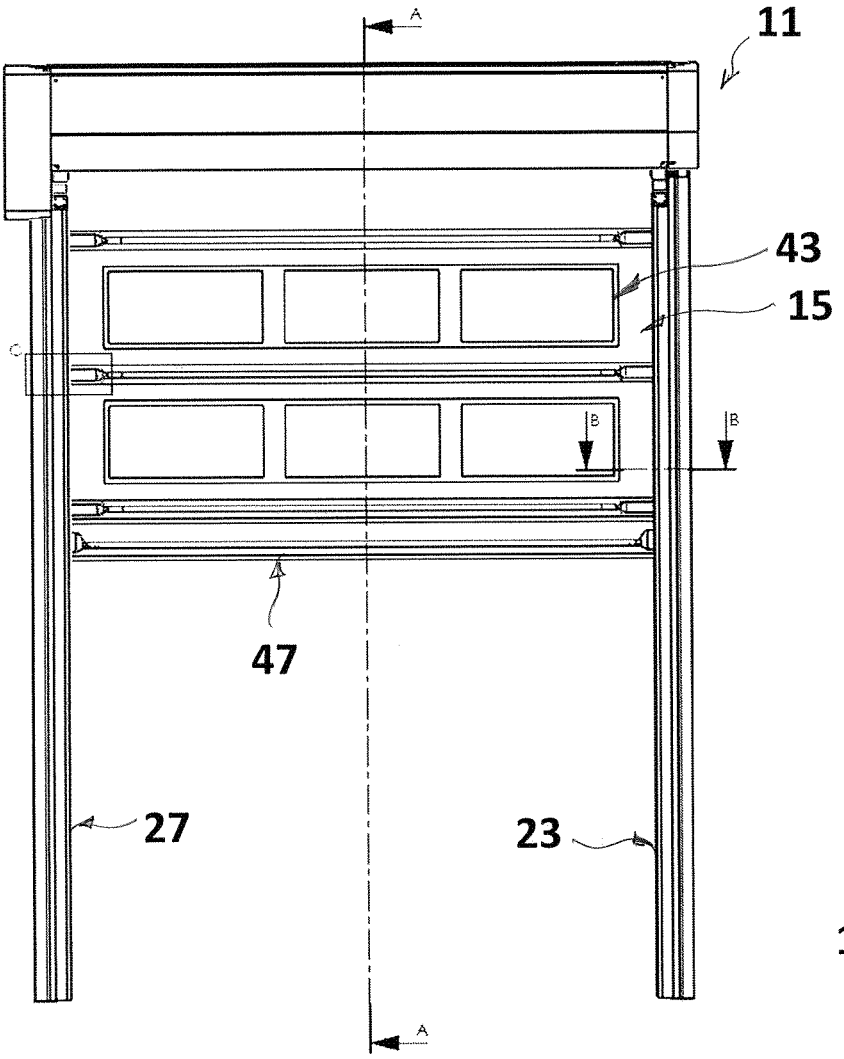

| | | | | |
|---|---|---|---|---|
| 3,842,890 | A | 10/1974 | Kramer | |
| 5,307,859 | A * | 5/1994 | Kraeutler | E06B 9/13 160/264 |
| 5,482,104 | A * | 1/1996 | Lichy | E06B 9/13 160/273.1 |
| 7,275,581 | B2 * | 10/2007 | Coenraets | E06B 9/17 160/273.1 |
| 7,516,770 | B2 * | 4/2009 | Jerry | E06B 9/13 160/267.1 |
| 8,291,960 | B2 * | 10/2012 | Bowman | E06B 9/17046 160/267.1 |
| 8,672,014 | B2 * | 3/2014 | Coenraets | E06B 9/581 160/273.1 |
| 9,260,911 | B2 * | 2/2016 | Gontarski | E06B 9/17 |
| 10,844,656 | B2 * | 11/2020 | Motosko | E04H 9/14 |
| 11,203,900 | B2 * | 12/2021 | Miller | E06B 9/581 |
| 2004/0182024 | A1 * | 9/2004 | Varley | E06B 9/70 52/243.1 |
| 2010/0006239 | A1 * | 1/2010 | Kraeutler | E06B 9/58 160/272 |
| 2012/0241107 | A1 | 9/2012 | Gontarski et al. | |
| 2012/0247692 | A1 * | 10/2012 | Panseri | E06B 9/581 160/349.2 |
| 2015/0292262 | A1 * | 10/2015 | Miller | E06B 9/13 160/270 |
| 2016/0376841 | A1 * | 12/2016 | Hentschel | E06B 9/581 160/270 |
| 2017/0009524 | A1 * | 1/2017 | Dwarka | E06B 9/42 |
| 2022/0018187 | A1 * | 1/2022 | Gregoriou | E06B 9/13 |

OTHER PUBLICATIONS

European Search Report issued in European Patent Application No. 18748307.8 dated Sep. 29, 2020.

* cited by examiner

ROLLER DOOR BLADES AND ROLLER DOORS

FIELD OF THE INVENTION

This invention relates to roller doors, and in particular, but not exclusively to rapid opening roller doors for use in doorways of warehouses and cool stores.

BACKGROUND

In situations where there are frequent movements through a doorway, there is often a requirement for a rapid opening door. Especially in warehouse situations where forklift trucks are continually moving into and out of a building, or are moving into and out of an environmentally controlled zone, for example into and out of a cool room or a clean room.

Doorways for forklifts need to be relatively high, and for this reason roller doors are often used. Rapid opening roller doors have been in use for many years, but they typically experience a number of problems. For example, the doors can be unreliable or are noisy, or are subject to blowing open in high wind gusts.

It is often desirable to construct the door blades of rapid opening roller doors from flexible materials, for example door blades made from fabric reinforced poly vinyl chloride (PVC) sheet material. The use of flexible sheet materials helps to reduce the total mass of the door blades and they are much quieter when operated compared to roller doors made of sheet metal, and can be more damage tolerant.

A disadvantage of using flexible materials however, is that roller doors made of flexible materials are easily blown out of their tracks by wind gusts.

The problem of wind resistance can be resolved by adding wind bars to the flexible sheet material. The wind bars are spaced apart battens or beams that are situated horizontally in the door blade or the door curtain panel. The wind bars can be steel, aluminium or fibreglass tubes for example. However these bars provide challenges when the roller door blade is rolled up onto a roller. A blade fitted with wind bars no longer rolls up evenly, and can tend to be a little jerky in its operation. The retraction of the door blade can become rough, speeding up and slowing down as each wind bar reaches the roller. This jerky movement can put additional load onto drive motors and transmissions, accelerating wear and causing premature failures.

In addition, the wind bars can tend to clunk together as they are rolled onto on the roller, and if they sit adjacent one another on the roller the accumulated door blade becomes very out of round and unbalanced.

Attempts have been made to space the wind bars carefully on the door blade in an attempt to ensure that the wind bars do not clash on the roller, but nest between one another. However, this tends to make the manufacture of the doors more complex, and experience has shown that slight inaccuracies or variations in manufacturing dimensions can result in wind bars clashing on the roller.

And in situations where more than one forklift may be operating, or there is additional traffic, it can be helpful to be able to see through the doors for improved safety. Clear plastic widows are sometimes included in the rapid opening roller doors, but these plastic sheets can quickly become scuffed and difficult to see through after the door has cycled a number of times. When this happens, the safety feature provided by the clear panels can be lost.

In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

OBJECT

It is therefore an object of the present invention to provide a roller door which will at least go some way towards overcoming one or more of the above mentioned problems, or at least provide the public with a useful choice.

STATEMENTS OF THE INVENTION

Accordingly, in a first aspect, the invention may broadly be said to consist in a roller door blade for a roller door, the roller door blade having a left edge and a right edge, the door blade being made of a flexible planar material and having one or more transverse wind bars supporting the planar material, and the door blade also having a plurality of longitudinally aligned spacer elements substantially along the length of the door blade.

Preferably the spacer elements have a thickness of approximately half the thickness of the wind bars when measured in a direction from a forward face of the door blade to a back face of the door blade.

Preferably the roller door blade includes a longitudinally aligned spacer element adjacent the left edge of the door blade and a longitudinally aligned spacer element adjacent the right edge of the door blade.

Preferably the spacer elements are made of a flexible material.

Preferably the spacer elements are made of a foamed and rubberised material.

Preferably the spacer elements are secured to the door blade within pockets attached to the door blades.

Preferably the spacer elements are fastened to the door blade in at least one location along the length of each spacer element.

Preferably the spacer elements are attached to the door blades in a manner that allows the spacer elements to expand longitudinally.

Preferably any pockets configured to secure the spacer elements to the door blade are longer than the spacer elements, thereby allowing longitudinal expansion of the spacer elements when the door blade is rolled onto the roller.

Preferably the wind bars are made of a flexible rigid material, for example a fibre reinforced resin based material like fibreglass.

Preferably the wind bars have a thickness perpendicular to a plane of the door blade greater than twenty five millimetres.

Preferably the door blade, and/or the pockets are made of a PVC coated fabric material.

Preferably the door blade includes clear plastic panels configured to allow vision through the door blade when the door blade is in the extended configuration.

Preferably the spacer elements are attached to a front face of the door blade.

Preferably the door blade further includes weights configured to assist in extending the door blade.

In a second aspect, the invention may broadly be said to consist in a roller door, the roller door having a roller, a roller door blade and longitudinal door blade guides, the roller door blade being supported on the roller when the door blade is in a retracted, or door open configuration, and the door blade being supported along a left edge by a left blade guide and along a right edge by a right blade guide when the door blade is in an extended, or door closed configuration, the door blade being made of a flexible planar material and having one or more transverse wind bars supporting the planar material, and the door blade also having a plurality of longitudinally aligned spacer elements substantially along the length of the door blade.

Preferably the spacer elements have a thickness of approximately half the thickness of the wind bars when measured in a direction from a forward face of the door blade to a back face of the door blade.

Preferably the roller door includes a longitudinally aligned spacer element adjacent the left edge of the door blade and a longitudinally aligned spacer element adjacent the right edge of the door blade.

Preferably the spacer elements are made of a flexible material.

Preferably the spacer elements are made of a foamed and rubberised material.

Preferably the spacer elements are secured to the door blade within pockets attached to the door blades.

Preferably the spacer elements are fastened to the door blade in at least one location along the length of each spacer element.

Preferably the spacer elements are attached to the door blades in a manner that allows the spacer elements to expand longitudinally.

Preferably any pockets configured to secure the spacer elements to the door blade are longer than the spacer elements, thereby allowing longitudinal expansion of the spacer elements when the door blade is rolled onto the roller.

Preferably the wind bars are made of a flexible rigid material, for example a fibre reinforced resin based material like fibreglass.

Preferably the wind bars have a thickness perpendicular to a plane of the door blade greater than twenty five millimetres.

Preferably the door blade, and/or the pockets are made of a pvc coated fabric material.

Preferably the door blade includes clear plastic panels configured to allow vision through the door blade when the door blade is in the extended configuration.

Preferably the spacer elements are attached to a front face of the door blade.

Preferably the left edge and the right edge of the door blade are aligned substantially vertical when the door blade is in the extended configuration.

Preferably the door blade further includes weights configured to assist in extending the door blade.

Preferably the roller door also includes a powered actuator configured to drive the roller to extend or retract the door blade.

In a third aspect, the invention may broadly be said to consist in a building incorporating at least one roller door substantially as specified herein.

The invention may also broadly be said to consist in the parts, elements and features referred to or indicated in the specification of the application, individually or collectively, and any or all combinations of any two or more of the parts, elements or features, and where specific integers are mentioned herein which have known equivalents, such equivalents are incorporated herein as if they were individually set forth.

DESCRIPTION

Figure 2:
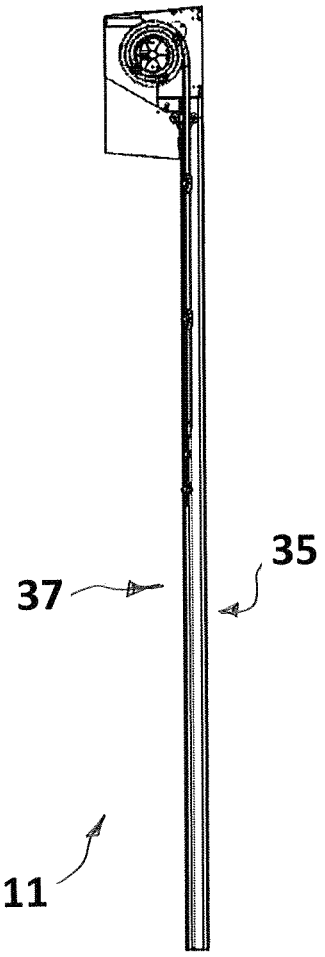
Figure 3:
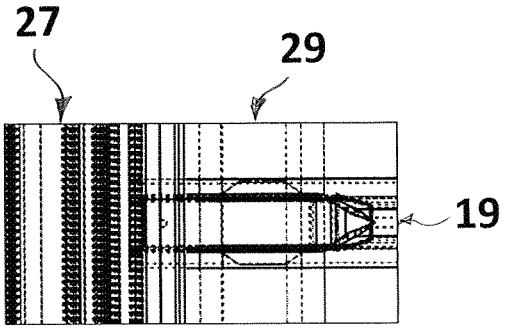
Figure 4:
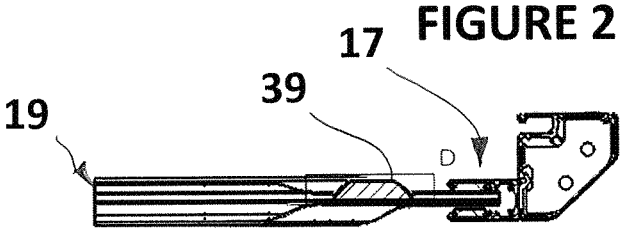
Figure 5:
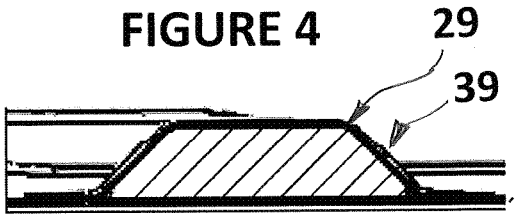
Figure 6:
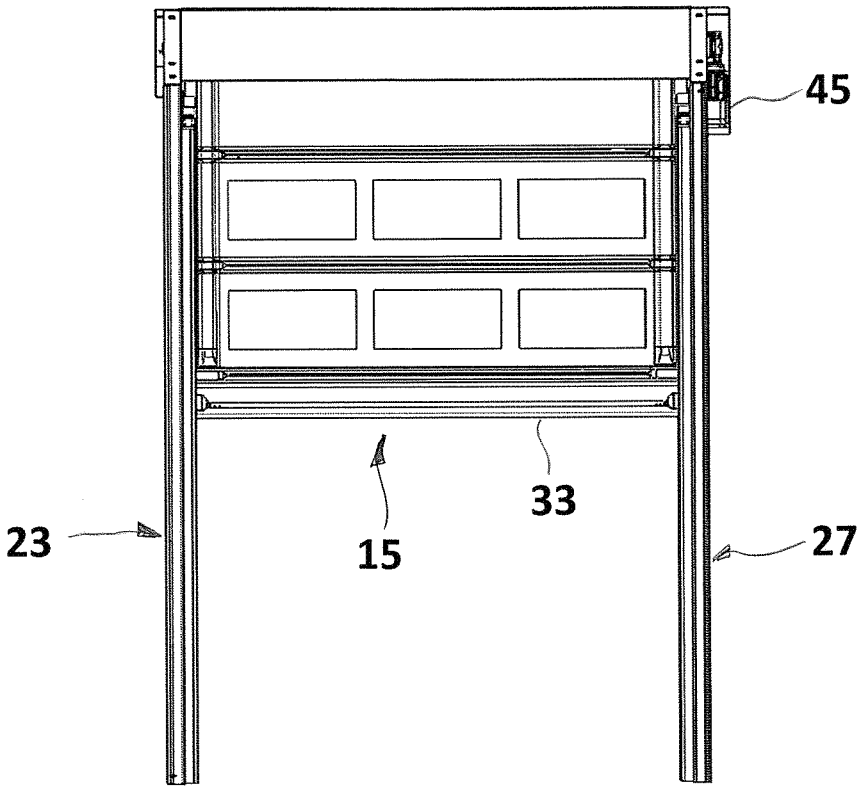
Figure 7:
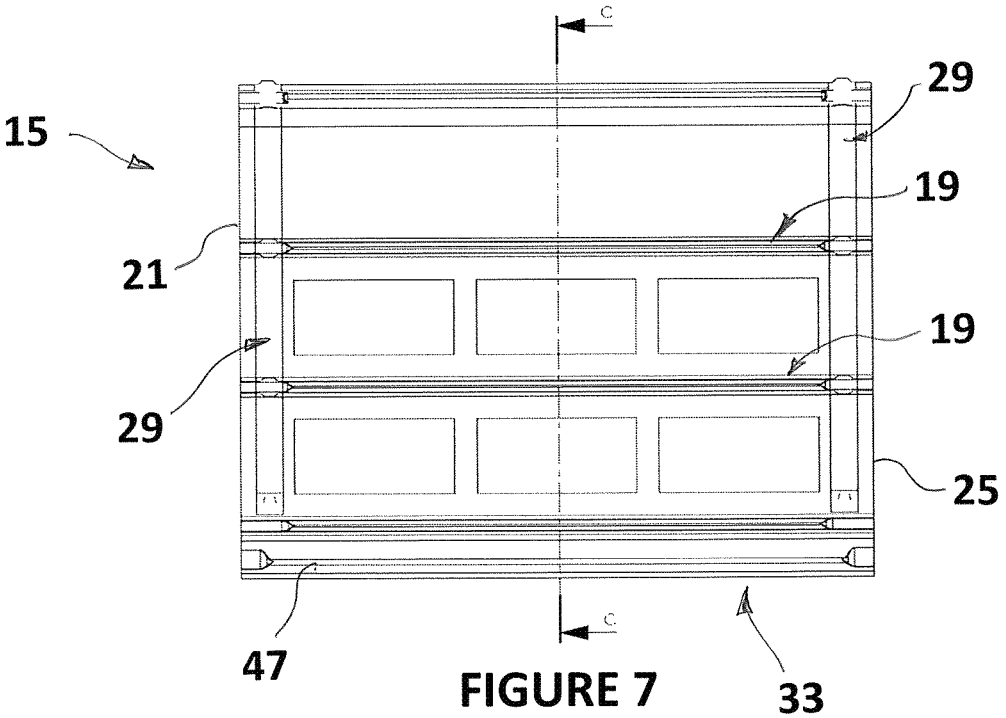
Figure 8:
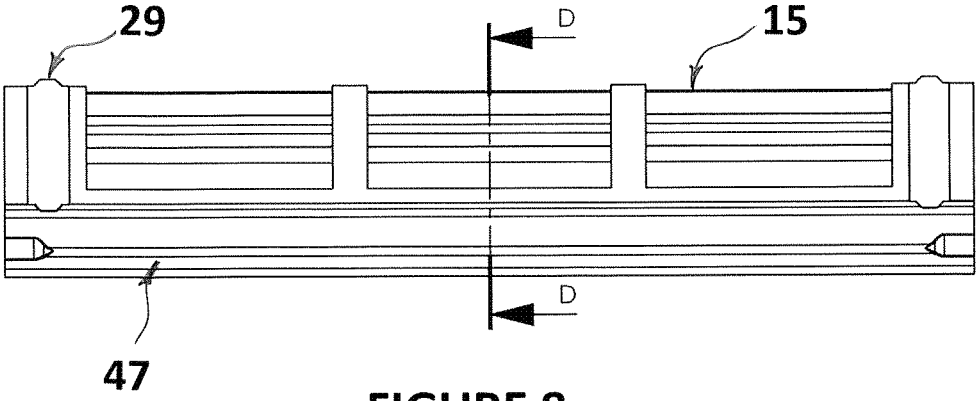
Figure 9:
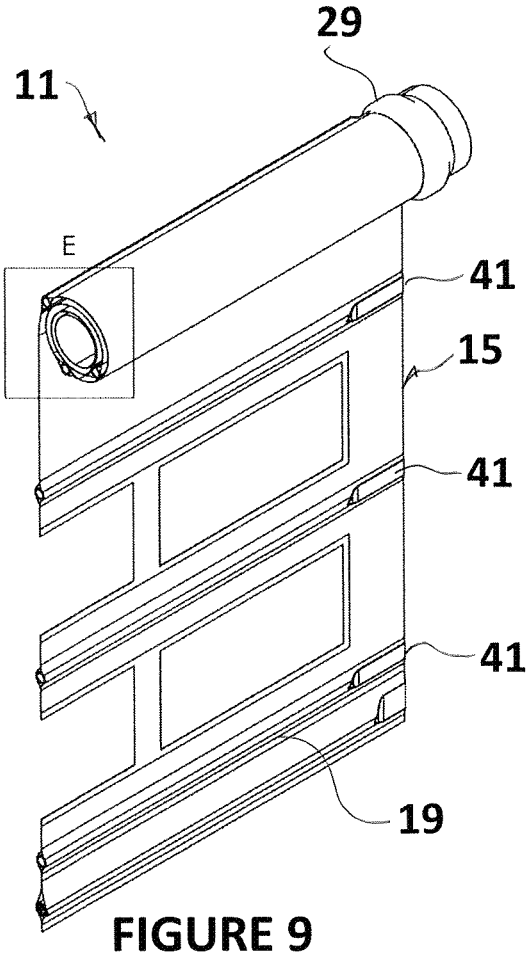
Figure 10:
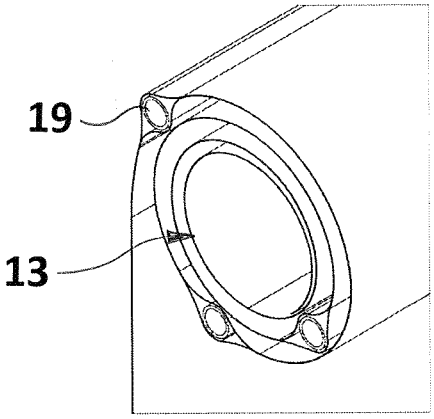
Figure 11:
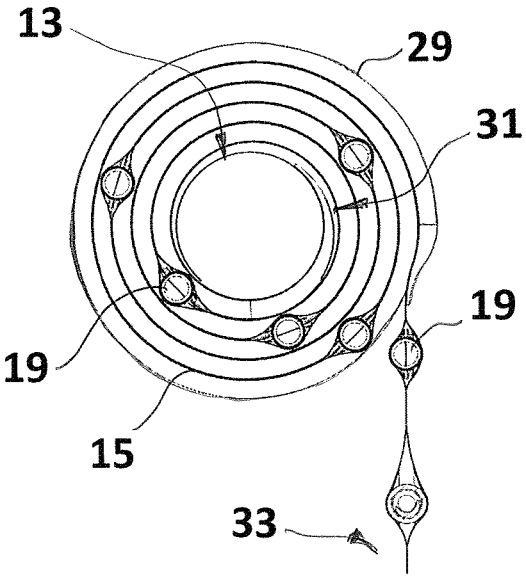

Further aspects of the present invention will become apparent from the following description which is given by way of example only and with reference to the accompanying drawings in which:

FIG. 1 is a rear elevation view of a roller door according to the present invention, FIG. 2 is a cross sectional side elevation view AA (as defined in FIG. 1) of the roller door, FIG. 3 is a detail view C (as defined in FIG. 1) showing an end of a wind bar of the roller door, FIG. 4 is a cross sectional plan view BB (as defined in FIG. 1) showing an edge of a door blade within a guide of the roller door, FIG. 5 is a detail view D (as defined in FIG. 4) showing a packer strip of the roller door, FIG. 6 is a front elevation view of the roller door, FIG. 7 is a front elevation view of the door blade of the roller door, the door blade being partially rolled up, FIG. 8 is a rear elevation view of the door blade of the roller door, the door blade being fully, or almost fully, rolled up, FIG. 9 is a perspective cross sectional view CC (as defined in FIG. 7) of the door blade, FIG. 10 is a detail perspective view E (as defined in FIG. 9) showing a top part of the partly rolled up door blade, FIG. 11 is a cross sectional view DD (as defined in FIG. 8) showing the door blade rolled onto a roller.

With reference to FIGS. 1 to 11, a roller door (11) according to the present invention will now be described. The roller door (11) has been designed particularly for use in commercial buildings, for example warehouses where forklifts are frequently passing through a doorway. A typical example is where goods are being loaded onto, or unloaded from trucks, and forklifts are passing into and out of a large logistics centre. In such cases it is usually desirable to have the doors open for the shortest time possible, to help maintain a desired temperature within the building, or to help keep dust, birds, insects, etc., out of the building.

As with existing roller doors, the roller door (11) has a roller (13), a door blade (15) and longitudinal door blade guides (17). The door blade (15) is rolled about, and is supported on the roller (13) when the door blade (15) is in a retracted, or door open configuration.

While the door blade (15) could be made of metal, it is considered desirable to have the door blade (15) made of a flexible planar material for example a plastics material, or a fabric reinforced plastics material. PVC coated fabric materials are considered particularly suitable, and clear plastic windows can be included in the door blade for improved safety.

Door blades made of flexible planar materials generally require stiffeners to prevent the doors blowing in as a result of wind gusts. And for this reason, the roller door (11) includes a number of wind bars (19) that are oriented in a transverse direction, spanning substantially from one side of the door blade (15) to the other, to support the planar material and to minimise the chance of the door blade being blown in by wind gusts.

The door blade (15) is supported along a left edge (21) by a left blade guide (23) and along a right edge (25) by a right blade guide (27) when the door blade (15) is in an extended, or door closed configuration. The left edge (21) and the right edge (25) of the door blade (15) are aligned substantially vertical when the door blade (15) is in the extended configuration.

The blade guides (23) and (27) include low friction plastic strips along their lengths to minimise wear on the edges (21) and (25) of the door blade (15) as the door blade (15) moves up and down through the blade guides (23) and (27).

Importantly the door blade (15) has two spacer elements (29), one adjacent to each edge (21) and (25) of the door blade (15). The spacer elements (29) are aligned longitudinally with respect to the door blade (15), that is, they run substantially from a top end (31) of the door blade (15) to a bottom end (33) along the length of the door blade (15).

The spacer elements (29) have a thickness of approximately half the thickness of the wind bars (19) when measured in a direction from a front face (35) of the door blade (15) to a back face (37) of the door blade (15).

In this example, the roller door (15) has a longitudinally aligned spacer element (29) adjacent the left edge (21) of the door blade (15) and a longitudinally aligned spacer (29) element adjacent the right edge (25) of the door blade (15). The spacer elements (29) extend substantially along the length of the door blade (15) from top to bottom.

The spacer elements (29) create a space between each adjacent layer of the material of the door blade (15) when it is rolled onto the roller (13). The space between each layer is sufficient to accommodate the thickness of the wind bars (19). The spacer elements (29) cause the roller blade (15) to roll onto the roller (13) in an even manner, producing an even spiral of wrapped material as shown in FIG. 11.

This provides a significant benefit over previous fabric roller doors which tend to roll up in a jerky manner as each wind bar is drawn onto the roller causing the door blade to move up in an erratic fashion. In contrast, the door blade (15) of the roller door (11) according to the present invention rolls onto the roller (13) is a very smooth, controlled and even manner.

The spacer elements (29) are made of a flexible material, for example a foamed and rubberised material, and the spacer elements (29) are secured to the door blade (15) within pockets (39) attached to the door blades (15). The pockets can be made of the same material used to make the door blade (15), for example a PVC coated fabric material.

The spacer elements (29) are fastened to the door blade (15) in at least one location along the length of each spacer element (29), for example using a mechanical fastener or by stitching a part of each spacer element (29) to the material of the door blade (15).

Since the spacer elements (29) are attached to the door blades (15) by the pockets (39), the spacer elements (29) are allowed to expand longitudinally. In addition, the pockets (39) are longer than the spacer elements (29). This additional length of the pockets (39) provides room for longitudinal expansion of the spacer elements (29) when the door blade (25) is rolled onto the roller (13). Trials have shown that the spacer elements (29) tend to expand longitudinally as they are compressed slightly as they enter the rolled layers of the door blade (15) on the roller (13).

The wind bars (19) are typically made of a flexible rigid material, for example a fibre reinforced resin based material like fibreglass, and are often in the form of hollow tubes. The wind bars (19) will typically have a thickness perpendicular to a plane of the door blade (15) that is greater than twenty five millimetres. In situations where the wind loadings are greater, thicker wind bars (19) are required. A feature of the roller door (11) is that thicker wind bars can be accommodated relatively simply by increasing the thickness of the spacer elements (29).

The wind bars (19) are relatively thin at each end. That is, the thickness of the wind bars tapers or steps down to a reduced thickness at each end of the wind bars to accommodate the spacer elements (29). For example, while the wind bars (19) may be twenty five millimetres thick along a majority of their length, their thickness tapers down to an end tongue (41) that is approximately five millimetres thick and which extends into the blade guides (17). The length of each end tongue (41) is sufficient to allow the wind bars (19) to engage securely within the blade guides (17) and to provide space to accommodate the spacer elements (29). This tapered shape of the wind bars (19) and an example of an end tongue (41) is most clearly evident in FIG. 4.

The door blade (15) includes a number of clear plastic panels or windows (43) configured to allow vision through the door blade (15) when the door blade (15) is in the extended configuration. These windows (43) can be an important safety feature where more than one forklift truck is operating as it allows the drivers to see if other traffic is coming from the other side.

The spacer elements (29), and the gap that is produced between adjacent layers of the material making up the door blade (15) when it is rolled onto the roller (13), provide another significant advantage in that they minimise contact and subsequent chafing between adjacent layers. This helps to significantly extend the life and clarity of any clear plastic panels or windows (43), improving the safety of the door (11) during the lifetime of each door blade (15).

The roller door (11) also includes a powered actuator (45) configured to drive the roller (13) to extend or retract the door blade (15). The powered actuator (45) is an electric motor with a reduction gearbox. And, as with existing fabric roller doors, the door blade (15) further includes weights (47) along its bottom edge that are configured to assist in extending or lowering the door blade (15).

Variations

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

In the example described above, the roller door (11) includes two spacer elements (29), one located adjacent each edge of the door blade (15). However it is envisaged that the roller door (11) could have any number of spacer elements (29), and they could be located at more locations on the door blade, for example a number of segmented spacer elements could be situated along a vertical centreline of the door blade (15), the spacer elements (29) each extending from one wind bar to an adjacent wind bar.

Also, in the example described above, the spacer elements (29) are only attached to the front face (35) of the door blade (15). It is envisaged that in an alternative embodiment the spacer elements (29) could be situated on the back face (37) of the door blade (15), or there could be thinner spacer elements on each face of the door blade (15).

As noted above, the spacer elements (29) could similarly be used on doors having a door blade made of metal rather than fabric. For example the spacer elements could be used on door blades made of aluminium panels to allow faster, smoother and/or quieter operation of the roller door and to reduce wear.

The roller door described above includes wind bars to help improve resistance to wind gusts. It is envisaged that the idea of the spacer elements (29) could also be used on roller doors that incorporate a wind-zip retention system, or wind button system to improve resistance to wind gusts.

Also, alternative spacer element (29) retention systems could be used. As an alternative to the pocket system used in the example described above, the spacer elements could be fastened externally, for example the spacer elements could be configured to engage with a flexible PVC extrusion that is sewn along its length to the door blade. The PVC extrusion could include a dove tail shaped section that engages with a complimentary shaped groove along the length of the spacer elements. Or alternatively a keder rail profile formed in the spacer elements could engage with a keder rope feature attached to the door blade. These configurations would still allow the spacer elements to move or expand longitudinally as the door blade is wound onto a roller or is unrolled.

Definitions

Throughout this specification the word "comprise" and variations of that word, such as "comprises" and "comprising", are not intended to exclude other additives, components, integers or steps.

ADVANTAGES

Thus it can be seen that at least the preferred form of the invention provides a roller door that incorporates a door blade made of a flexible material and which is suitable for use as a rapid opening door, while at the same time having the following features or advantages;

Quiet operation,

Smooth operation,

Flexible design allowing robust wind bars to be used,

Reduced chance of the rolled up door blade becoming poorly balanced,

Reduced chance of chafing extending visual clarity of clear plastic window panels, and A door lift motion that is not hard on the drive motor.

The invention claimed is:

1. A roller door blade for a roller door, the door blade having a left edge, a right edge, and a longitudinal length extending from a top of the door blade to a bottom of the door blade, the door blade comprising:

a flexible planar material;

one or more transverse wind bars supporting the planar material;

a first longitudinally aligned spacer element adjacent the left edge of the door blade; and a second longitudinally aligned spacer element adjacent the right edge of the door blade, wherein said first and second spacer elements each extend substantially along the longitudinal length of the door blade from the top of the door blade to the bottom of the door blade, wherein a thickness, at each end of the one or more transverse wind bars, tapers or steps down to a reduced thickness to accommodate a thickness of said spacer elements located at each end of the one or more transverse wind bars, and wherein said spacer elements are secured to the door blade within pockets attached to the door blade in a manner that allows the spacer elements to expand longitudinally.

2. The roller door blade as claimed in claim 1, wherein each end of the one or more wind bars includes an end tongue, and each end tongue is configured to extend into a blade guide of a roller door when the roller door blade is in use.

3. The roller door blade as claimed in claim 1, wherein the spacer elements are fastened to the door blade in at least one location along a length of each spacer element.

4. The roller door blade as claimed in claim 1, wherein each of the spacer elements are attached to the door blades in one location.

5. The roller door blade as claimed in claim 1, wherein the one or more wind bars are made of a flexible rigid material.

6. The roller door blade as claimed in claim 1, wherein the one or more wind bars have a thickness perpendicular to a plane of the door blade greater than twenty five millimetres.

7. The roller door blade as claimed in claim 1, further comprising:

clear plastic panels configured to allow vision through the door blade when the door blade is in the extended configuration.

8. The roller door blade as claimed in claim 1, wherein the spacer elements are attached to a front face of the door blade.

9. The roller door blade as claimed in claim 1, further comprising:

weights configured to assist in extending the door blade.

10. The roller door blade as claimed in claim 1, wherein the spacer elements have a thickness of approximately half a thickness of the one or more wind bars measured in a direction from a forward face of the door blade to a back face of the door blade.

11. The roller door blade as claimed in claim 10, wherein said pockets are longer than the spacer elements so as to allow longitudinal expansion of the spacer elements when the door blade is rolled onto a roller.

12. The roller door blade as claimed in claim 11, wherein each of the spacer elements are attached to the door blades in one location.

13. The roller door blade as claimed in claim 10, wherein each end of the one or more wind bars includes an end tongue, and each end tongue is configured to extend into a blade guide of a roller door when the roller door blade is in use.

14. The roller door blade as claimed in claim 1, wherein the spacer elements are made of a flexible material.

15. The roller door blade as claimed in claim 14, wherein the spacer elements are made of a foamed rubber material.

16. The roller door blade as claimed in claim 1, wherein said pockets are longer than the spacer elements so as to allow longitudinal expansion of the spacer elements when the door blade is rolled onto a roller.

17. The roller door blade as claimed in claim 16, wherein the door blade and/or the pockets are made of a PVC coated fabric material.

18. The roller door blade as claimed in claim 16, wherein each of the spacer elements are attached to the door blades in one location.

19. A roller door, comprising:

a roller;

roller door blades; and left and right longitudinal door blade guides, each roller door blade of the roller door blades having a left edge, a right edge, and a longitudinal length extending from a top of the door blade to a bottom of the door blade, each door blade comprised of a flexible planar material, one or more transverse wind bars supporting the planar material, a first longitudinally aligned spacer element adjacent the left edge of the door blade, and a second longitudinally aligned spacer element adjacent the right edge of the door blade, said first and second spacer elements each extending substantially along the longitudinal length of the door blade from the top of the door blade to the bottom of the door blade, and a thickness, at each end of the one or more transverse wind bars, tapering or stepping down to a reduced thickness to accommodate a thickness of said spacer elements, each roller door blade being supported on the roller when the door blade is in a retracted configuration, and the door blade being supported along the left edge by a left blade guide and along the right edge by a right blade guide when the door blade is in an extended configuration, and said spacer elements being secured to the door blade within pockets attached to the door blade in a manner that allows the spacer elements to expand longitudinally.

20. A building incorporating the roller door as claimed in claim 19.

* * * * *